US005721388A

United States Patent [19]

Shih

[11] Patent Number: 5,721,388

[45] Date of Patent: Feb. 24, 1998

[54] MOBILE MUSIC-PRODUCING ORNAMENT

[76] Inventor: Barry Shih, 2F, No. 321,Pateh Rd., Sec. 4, Taipei 10563, Taiwan

[21] Appl. No.: 708,129

[22] Filed: Aug. 14, 1996

[51] Int. Cl.[6] ..... G10F 1/06

[52] U.S. Cl. ..... 84/95.2; 40/457; 446/298; 446/303

[58] Field of Search ..... 84/95.2, 95.1, 84/94.1, 94.2; 40/457, 453; 446/298, 303

[56] References Cited

U.S. PATENT DOCUMENTS 5,088,373 2/1992 Hou ..... 84/95.2

*Primary Examiner*—Cassandra C. Spyron
*Assistant Examiner*—Shih-yung Hsieh
*Attorney, Agent, or Firm*—W. Wayne Liauh

[57] ABSTRACT

A mobile music-producing ornament which mainly includes a hollow housing to accommodate a base board, a music-producing device, a swing mechanism and a reciprocation mechanism therein. With gear sets provided among the music-producing device, the swing mechanism, and the reciprocation mechanism, the rotating music-producing device shall bring the other two mechanisms to swing leftward and rightward and to reciprocate back and forth, respectively, permitting small decorative figures and the like on the ornament to laterally swing or to move back and forth along with the rhythm of pleasant music, giving the ornament more funs.

1 Claim, 4 Drawing Sheets

MOBILE MUSIC-PRODUCING ORNAMENT

BACKGROUND OF THE INVENTION

1. Field of the Invention

The present invention relates to a mobile music-producing ornament, and more particularly to a mobile music-producing ornament in which a part of the decorative items thereof can laterally swing or move back and forth while the ornament produces pleasant music.

2. Description of the Prior Art

It is a very natural thing that people will use some cute and interesting ornaments to beautify their monotonous home or office environment. These cute and fine ornaments are particularly welcomed by ladies. The conventional ornaments usually include only one individual body. These ornaments although have different designs in their appearance, they do not have other functions or usages. Generally speaking, they are monotonous and without changes.

SUMMARY OF THE INVENTION

It is a primary object of the present invention to provide a mobile music-producing ornament having a decorative housing in which a music-producing means, a swing mechanism, and a reciprocation mechanism are mounted. When a spring in the music-producing means is tightened and then released to allow the music-producing means to produce pleasant music, gears in the housing shall drive the swing and the recipro-cation mechanisms to move, causing decorative items on the housing and attached to the mechanisms to move along with the pleasant music, giving the ornament much more funs.

DETAILED DESCRIPTION OF THE PREFERRED EMBODIMENT

Figure 1:
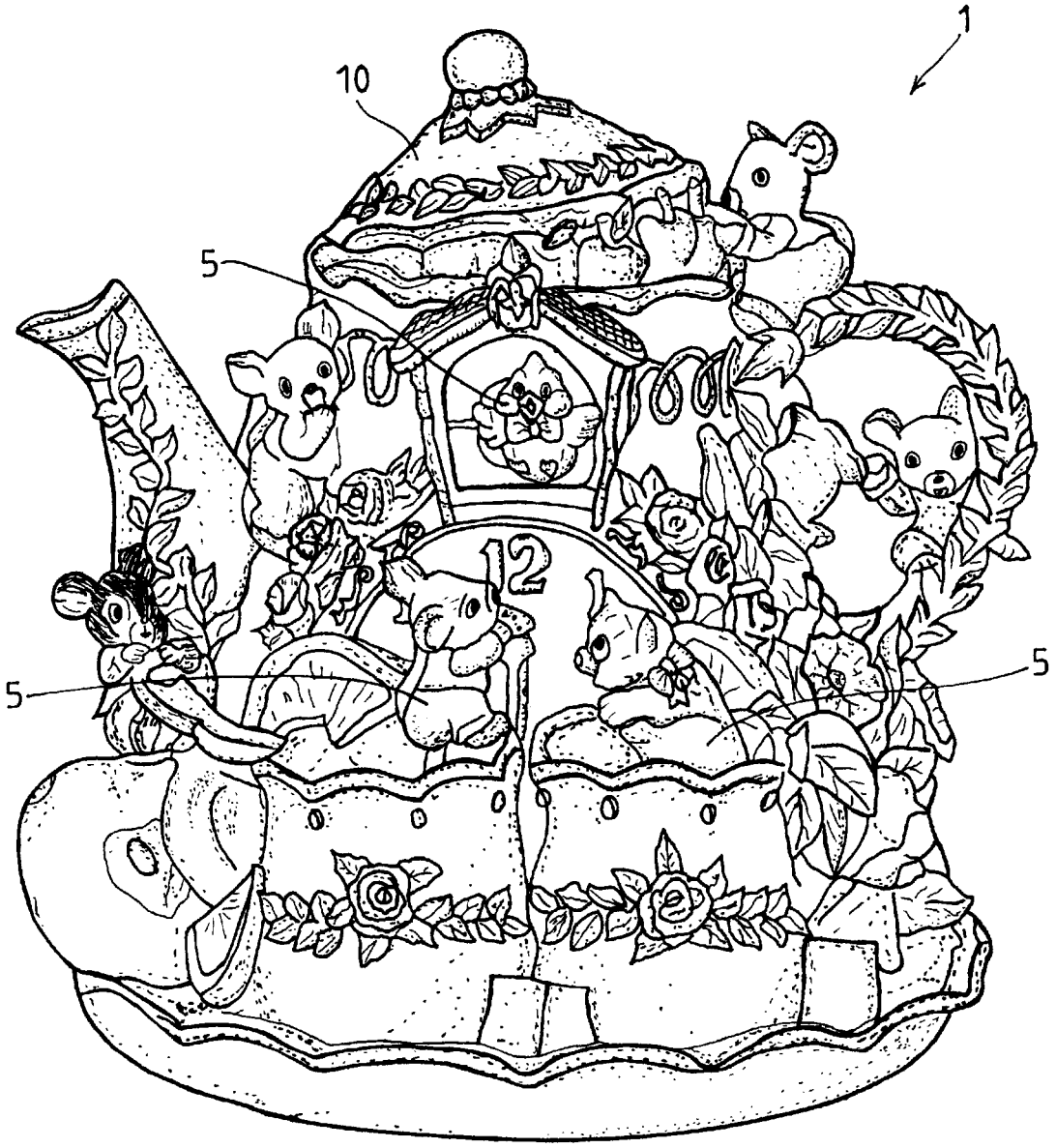
FIG. 1 is a front view of an embodiment of the mobile music-producing ornament according to the present invention.
Figure 2:
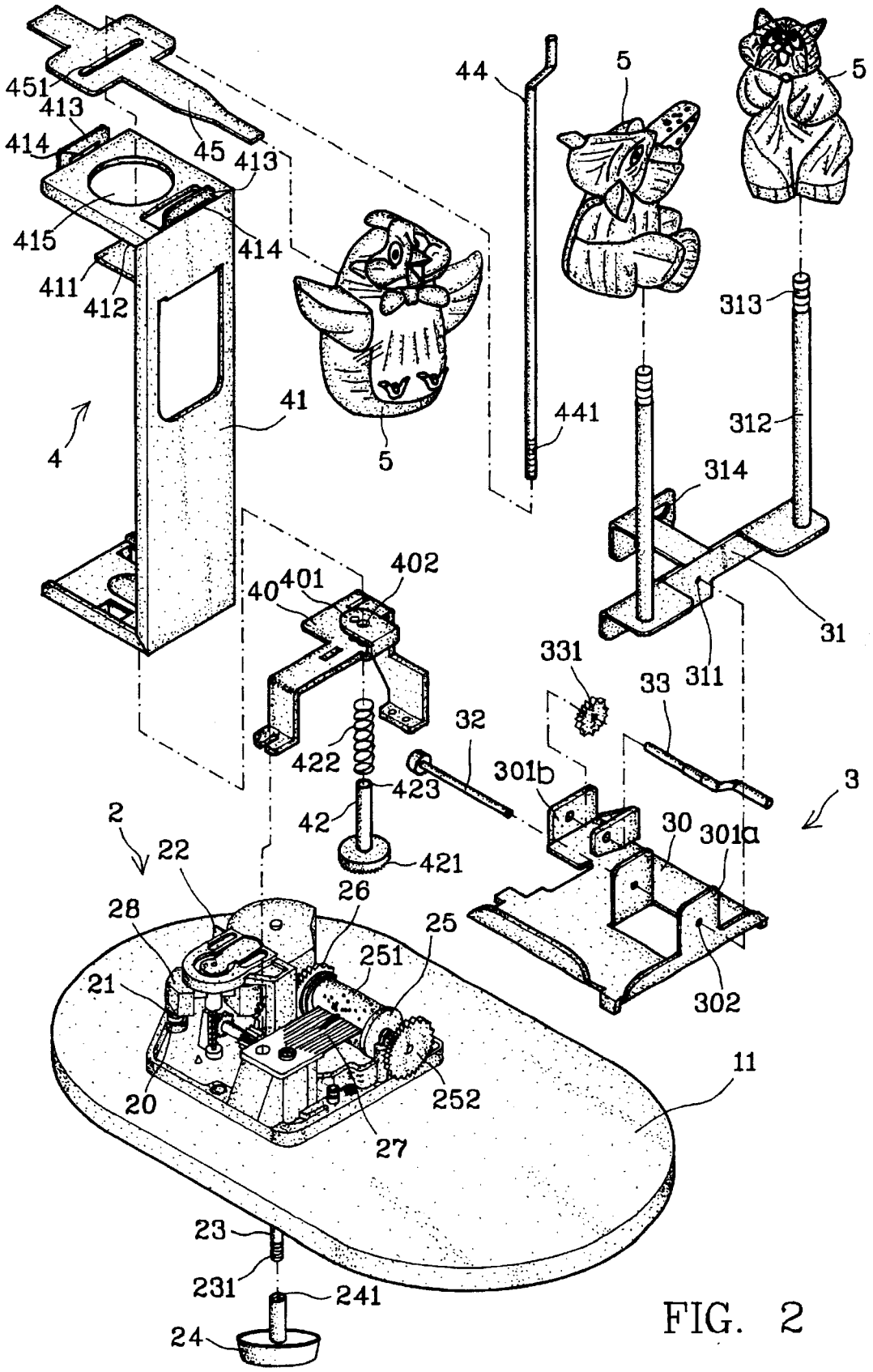
FIG. 2 is an exploded perspective view showing an internal structure of the present invention.

Please refer to FIGS. 1 and 2. The present invention is a mobile music-producing ornament 1 which mainly includes a housing 10, a base board 11, a music-producing means 2, a swing mechanism 3, and a reciprocation mechanism 4.

The housing 10 is a hollow member defining an inner space for the mobile music-producing ornament 1, the base board 11 is detachably connected to a bottom of the housing 10 by any suitable conventional means. The music-producing means 2 is fixedly locked to an upper side of the base board 11 by means of upward threaded screws 21 through holes (not shown) formed on the base board 11 and into a main frame 20 of the music-producing means 2.

The music-producing means 2 includes a main frame 20 screwed to the base board 11, a spring 22 fixed to one side of a top surface of the main frame 20, a winding shaft 23 perpendicularly connected at a top end to a center of the spring 22, a cylinder 25 mounted on the main frame 20 adjacent to the spring 22 and having specially arranged bosses 251 formed on a circumferential surface thereof, a first gear 26 fixed to an inner end of a shaft of the cylinder 25, a second gear 252 fixed to an outer end of the shaft of the cylinder 25, a leaf spring 27 formed from several parallelly arranged springy strips and being so mounted that a front edge thereof contacts with the embossed circumferential surface of the cylinder 25, and a blade-shaped flywheel 28 also mounted on the main flame 20. The winding shaft 23 has a lower end formed with external thread 231 projected out of the base board 11 for engaging with an internal thread 241 of a turning knob 24 and thereby connects the turning knob 24 thereto.

The swing mechanism 3 mainly includes a base plate 30, and a swing member 31 movably connected to the base plate 30 by means of a round pin 32 and a crankpin 33. The base plate 30 has a first pair of vertically and upwardly extended shaft seats 301*a* formed at one lateral edge thereof and a second pair of vertically and upwardly extended shaft seats 301*b* formed at a corner on another lateral edge opposite to the first pair of shaft seats 301*a*. Both the first and the second pairs of shaft seats 301*a* and 301*b* are provided with a round central hole 302 each. The base plate 30 is mounted on the base board 11 to abut on one side of the main frame 20 of the music-producing means 2 near the cylinder 25 and the second gear 252. The swing member 31 includes a head portion having two horizontally and forward extended planes formed at two outer ends thereof and a tail portion horizontally and backward extended from a rear side of the head portion. The head and the tail portion each has a round central hole 311. The swing member 31 is positioned on top of the first pair of shaft seats 301*a* with the head portion abutted against an outer shaft seat thereof and the tail portion against an inner shaft seat thereof, such that the round pin 32 threads the round central holes 302 and 311 to secure the swing member 31 to the base plate 30 but allow the swing member 31 to turn about the round pin 32 and relative to the base plate 30. The two forward extended planes of the head portion of the swing member 31 are symmetrically shaped and each has a vertically and upward projected round stem 312 thereon. The round stem 312 each has grooves 313 provided to a top end thereof for inserting into a hole (not shown) provided to a bottom of a decorative FIG. 5 or the like. Glue may be applied to the grooved end of the round stems 312 to enhance the connection of the decorative figures 5 to the round stems 312. The tail portion of the swing member 31 is formed with a substantially oblong slot 314. The crankpin 33 extends an end of its straight portion through the round holes 302 formed on the second pair of shaft seats 301*b* with a third gear 331 secured thereto between the two second shaft seats 301*b*. The crankpin 33 further extends an end of its crank portion into the oblong slot 314 of the tail portion of the swing member 31. The third gear 331 engages with the second gear 252 at the outer side of the cylinder 25. When the cylinder 25 rotates, the second gear 252 shall bring the third gear 331 to rotate, too, and thereby causes the crankpin 33 to rotate within the oblong slot 314, bringing the swing member 31 to swing leftward and rightward.

Figure 4:
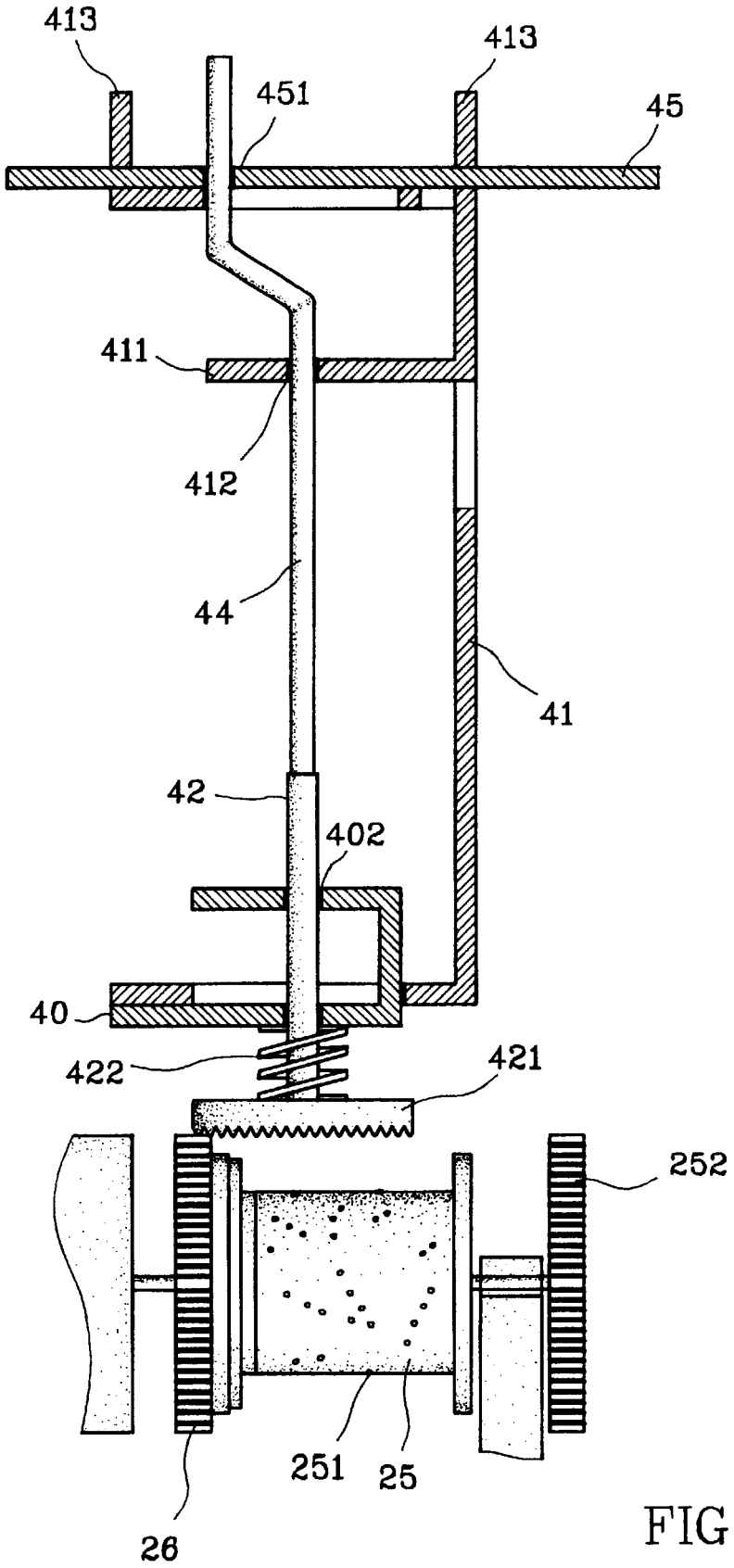
FIG. 4 is a fragmentary, sectional view showing the relation between the reciprocation mechanism and the music-producing means.

The reciprocation mechanism 4 mainly includes a fixing seat 40 mounted on the base board 11 above the music-producing means 2 by means of screws, a supporting frame 41 fixed on the fixing seat 40, a transmission shaft 42 provided at a lower end with a disc gear wheel 421 and at an upper end with an internally threaded hole 423, a long crankpin 44 having a lower straight end provided with external thread 441 and an upper crank end, and a movable member 45 having two narrowed end portions and a widened middle portion. The fixing seat 40 is formed at a top face with a shaft seat 401. Both the fixing seat 40 and the shaft seat 401 have a coaxial shaft hole 402. The transmission shaft 42 has a compression spring 422 put therearound and upward extends through the shaft holes 402 of the fixing seat 40 and the shaft seat 401. The disc gear wheel 421 of the transmission shaft 42 meshes with the first gear 26. The compression spring 422 always presses the disc gear wheel 421 against the first gear 26. The supporting frame 41 is also provided near an upper end with a shaft seat 411 having a shaft hole 412. Two horizontal planes separately sideward projected from the supporting frame 41 with the top plane formed with a big round hole 415. Two vertically and upward extended ears 413 are separately provided to two ends of the top plane of the supporting frame 41 and each is formed with a rectangular opening 414 for two ends of the movable member 45 to extend through. The lower externally threaded straight end of the long crankpin 44 is downward inserted into a slot 451 formed on the widened middle portion of the movable member 45, the big hole 415, the shaft hole 412, and finally screwed into the top threaded hole 423 of the transmission shaft 42 and is fixed thereto. The upper crank end of the crankpin 44 is located above the big hole 415 with its top end projected from the slot 451 of the movable member 45. As shown in FIG. 4, when the cylinder 25 of the music-producing means 2 rotates, the first gear 26 at one side of the cylinder 25 meshes with the disc gear wheel 421 of the transmission shaft 42, driving the crankpin 44, which is threaded into the transmission shaft 42, to rotate. The upper crank end of the rotating crankpin 44 rotates in the big round hole 415 and thereby causes the movable member 45 to reciprocate back and forth in a path defined by the rectangular holes 414 of the ears 413 on top of the supporting frame 41. A decorative FIG. 5 may be connected to an end of the movable member 45 by any suitable means, such as glue, to increase the fun of the mobile ornament 1.

Figure 3:
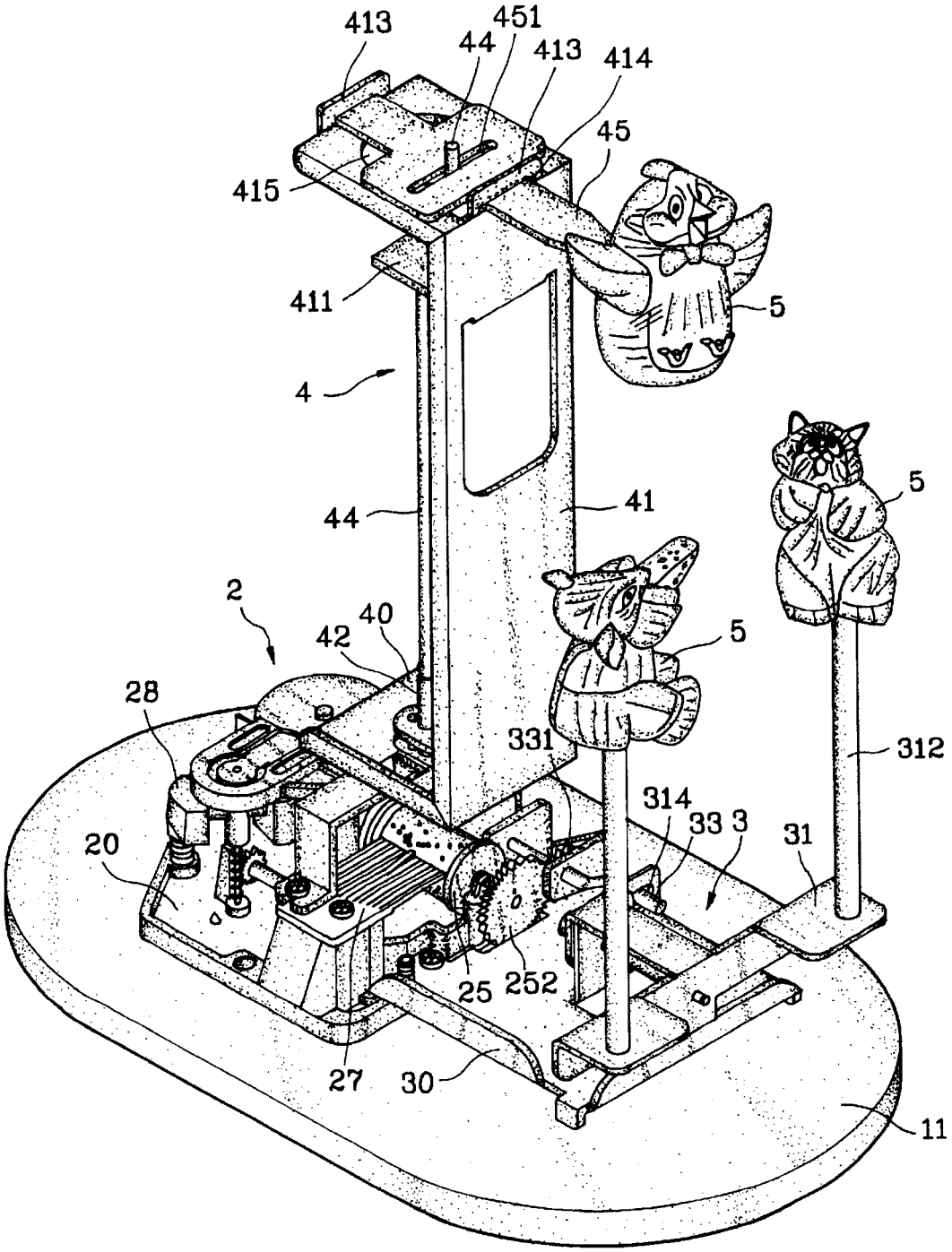
FIG. 3 is an assembled perspective view showing the internal structure of the present invention.

Please refer back to FIG. 3. When the spring 22 of the music-producing means 2 is tightened by turning the konb 24 and accordingly the winding shaft 23 and then be released, a kinetic energy provided by the wound and released spring 22 causes the cylinder 25 to rotate and be touched by the leaf spring 27 to produce pleasant music. Meanwhile, the gears 26 and 252 at two sides of the cylinder 25 respectively actuate the swing mechanism 3and the reciprocation mechanism 4, permitting decorative FIGS. 5 connected to the swing member 31 and the movable member 45 to swing or move back and forth following the rhythm of the pleasant music, forming a mobile music-producing ornament which provides more funs to the consumers.

Although the present invention has been described with the preferred embodiments thereof, it should be noted that the present invention is not limited to such embodiments and various changes can be made without departing from the spirit of the present invention or the scope of the subjoined claims.

What is claimed is:

1. A mobile music-producing ornament, comprising:

a housing defining an inner space for said ornament to accommodate various parts thereof;

a base board fixed to a bottom of said housing, said base board being provided with a plurality of holes for screws to thread through;

a music-producing means including a main frame screwed to said base board, a spring fixed to one side of a top surface of said main frame, a winding shaft perpendicularly connected at a top end to a center of said spring, a cylinder mounted on said main frame adjacent to the spring and having specially arranged bosses formed on a circum-ferential surface thereof, a first gear fixed to an inner end of a shaft of said cylinder, a second gear fixed to an outer end of the shaft of said cylinder, a leaf spring formed from several parallelly arranged springy strips and being so mounted that a front edge thereof contacts with said embossed circumferential surface of said cylinder, and a blade-shaped flywheel also mounted on said main flame; said winding shaft having a lower end formed with external thread projected out of said base board for engaging with an internal thread of a turning knob and thereby connects said turning knob thereto;

a swing mechanism including a base plate fixed to said main frame of said music-producing means, a swing member movably connected to said base plate by means of a round pin and a crankpin, said base plate having a first pair of vertically and upwardly extended shaft seats formed at one lateral edge thereof and a second pair of vertically and upwardly extended shaft seats formed at a corner on another lateral edge opposite to said first pair of shaft seats, both said first and said second pairs of shaft seats being provided with a round central hole each; said base plate being mounted on said base board to abut on one side of said main frame of said music-producing means near said cylinder and said second gear; said swing member including a head portion having two horizontally and forward extended planes formed at two outer ends thereof and a tail portion horizontally and backward extended from a rear side of said head portion, said head and said tail portion each having a round central hole, said swing member being positioned on top of said first pair of shaft seats with said head portion abutted against an outer shaft seat thereof and said tail portion against an inner shaft seat thereof, such that said round pin threads said round central holes to secure said swing member to said base plate but allow said swing member to turn about said round pin and relative to said base plate, two forward extended planes of said head portion of said swing member being symmetrically shaped and each having a vertically and upward projected round stem thereon, said round stem each having grooves provided to a top end thereof for inserting into a hole provided to a bottom of a decorative figure or the like, said tail portion of said swing member being formed with a substantially oblong slot, said crankpin extending an end of its straight portion through said round holes formed on said second pair of shaft seats with a third gear secured thereto between said two second shaft seats, said crankpin further extending an end of its crank portion into said oblong slot of said tail portion of said swing member, said third gear engaging with said second gear at the outer side of said cylinder, whereby when said cylinder rotates, said second gear brings said third gear to rotate, too, and thereby causes said crankpin to rotate within said oblong slot, bringing said swing member to swing leftward and rightward; and a reciprocation mechanism including a fixing seat mounted on said base board above said music-producing means by means of screws, a supporting frame fixed on said fixing seat, a transmission shaft provided at a lower end with a disc gear wheel and at an upper end with an internally threaded hole, a long crankpin having a lower straight end provided with external thread and an upper crank end, and a movable member having two narrowed end portions and a widened middle portion; said fixing seat being formed at a top face with a shaft seat, both said fixing seat and said shaft seat having a coaxial shaft hole; said transmission shaft having a compression spring put therearound and upward extended through said shaft holes of said fixing seat and said shaft seat, said disc gear wheel of said transmission shaft meshing with said first gear, said compression spring always presses said disc gear wheel against said first gear; said supporting frame also being provided near an upper end with a shaft seat having a shaft hole, two horizontal planes separately sideward projected from said supporting frame with a top plane formed with a big round hole, two vertically and upward extended ears separately provided to two ends of said top plane of said supporting frame and each being formed with a rectangular opening for two ends of said movable member to extend through, said lower externally threaded straight end of said long crankpin being downward inserted into a slot formed on said widened middle portion of said movable member, said big hole, said shaft hole, and finally screwed into said top threaded hole of said transmission shaft and being fixed thereto, said upper crank end of said crankpin being located above said big hole with its top end projected from said slot of said movable member, whereby, when said cylinder of said music-producing means rotates, said first gear at one side of said cylinder meshes with the disc gear wheel 421 of the transmission shaft, driving said crankpin to rotate, said upper crank end of said rotating crankpin also rotating in said big round hole and thereby causing said movable member and accordingly a decorative figure connected to an end of said movable member to reciprocate back and forth in a path defined by said rectangular holes of said ears on top of said supporting frame.

* * * * *